US006505441B1

(12) United States Patent
Shuey et al.

(10) Patent No.: US 6,505,441 B1
(45) Date of Patent: Jan. 14, 2003

(54) ACCESS DOOR FOR DUCTWORK

(75) Inventors: Alan B. Shuey, Monongahela, PA (US); Vincent L. Bloom, Roscoe, PA (US)

(73) Assignee: Ductmate Industries, Inc., East Monongahela, PA (US)

( * ) Notice: Subject to any disclaimer, the term of this patent is extended or adjusted under 35 U.S.C. 154(b) by 0 days.

(21) Appl. No.: 09/809,486

(22) Filed: Mar. 15, 2001

(51) Int. Cl.[7] ..... E06B 3/32; E05C 21/02
(52) U.S. Cl. ..... 49/463; 49/465; 138/92
(58) Field of Search ..... 49/463, 465; 138/92; 220/663

(56) References Cited

U.S. PATENT DOCUMENTS 624,715 A * 5/1899 Wenz ..... 138/92
780,324 A * 1/1905 Cross ..... 220/327
793,976 A * 7/1905 Armentrout ..... 49/465
868,076 A * 10/1907 Cross ..... 220/327
973,794 A * 10/1910 Lightcap ..... 15/104.061
3,347,341 A * 10/1967 Avrea ..... 184/108
3,654,379 A * 4/1972 Rodgers ..... 174/35 GC
4,233,697 A * 11/1980 Cornwall ..... 4/252.4
4,530,443 A * 7/1985 Gorges ..... 220/327
4,572,240 A * 2/1986 Van Becelaere ..... 138/92
4,643,878 A * 2/1987 Seiter et al. ..... 422/101
4,913,127 A * 4/1990 Dugger ..... 126/299 R
5,165,189 A * 11/1992 Besal ..... 49/463
5,775,414 A * 7/1998 Graham ..... 165/158
5,901,502 A * 5/1999 Rafalski et al. ..... 49/463

* cited by examiner

*Primary Examiner*—Gregory J. Strimbu
(74) *Attorney, Agent, or Firm*—Paul A. Beck & Associates

(57) ABSTRACT

A duct access door for use with ducts that carry cooking vapors and greases is a "sandwich" type door that has inner and outer plates, the inner plate being positioned inside the duct and the outer plate outside the duct with a heat resistant gasket attached to the outer plate. Strategically located bolts draw the plates together at their corners to provide compression of the gasket and prevent leaking of vapors and greases.

6 Claims, 3 Drawing Sheets

ACCESS DOOR FOR DUCTWORK

BACKGROUND OF THE INVENTION

1. Field of the Invention

This invention relates generally to the field of access doors providing access to the interior of a duct, and specifically to an access door designed to provide easy access to the interior of grease ducts and other ducts serving, for example, commercial and institutional kitchens, allowing the cleaning, servicing, and inspection of the ducts, or any wires, equipment, or other components located within the ductwork.

2. Prior Art

Access doors for ductwork are well known in the prior art. Historically, access doors formed from two plates with a gasket between the plates have been known. The access doors are bolted together so that the two plates may be separated in distance and then the inner plate is inserted into the duct through the duct opening. The outer plate and the gasket remain outside the duct and, when the bolts are tightened, the two plates are drawn together to seal the opening in the duct. This generic type of duct access door has become known as a "sandwich" door for obvious reasons.

To enter the sheet metal ductwork, access openings are usually cut in a rectangular shape which permits the inner plate of a "sandwich" access door to be maneuvered through the diagonal of the rectangular opening and to be positioned inside the duct.

As ducts have come to be used in kitchen service to remove vapors and grease from cooking areas, duct access doors have become more sophisticated in order to obtain approval by Underwriters Laboratories for use in an environment where grease and cooking vapors are present since a fire may occur inside the duct under such conditions. Access doors approved by Underwriters Laboratories must completely seal the duct in order to obtain such approval.

One type of access door which has obtained Underwriters' approval is described in U.S. Pat. No. 5,165,189 issued Nov. 24, 1992 to Bernard P. Besal. This access door requires a frame that must be retrofitted into the duct opening in order to receive a cover with a gasket. This retrofitting is time consuming and expensive and requires a multiplicity of fasteners in order to obtain the necessary sealing.

Historically, the sandwich-type access doors have not been able to meet the sealing requirements of the Underwriters Laboratories for use with grease ducts serving, for example, commercial and institutional kitchens. The present invention provides a sandwich-type access door which meets the Underwriters Laboratories' requirements and has been approved by Underwriters Laboratories.

BRIEF SUMMARY OF THE INVENTION

An access door to allow access to the interior of a duct having a rectangular opening formed in the duct is provided. The access door includes first and second rectangular plates which are larger in both dimensions than the rectangular duct opening. The first rectangular plate has at least two bolts fixed to it that project outwardly from the first rectangular plate and the first rectangular plate also has at least four threaded apertures at the corners of the plate to receive bolts. The second rectangular plate which is of the same size as the first plate has holes registering with the bolts fixed to the first plate and with the threaded apertures at the corners of the first plate. A non-flammable gasket which can withstand temperatures resulting from burning debris located within a duct is fixed to the second plate and positioned between the first and second plates and is coextensive with the plates. Nuts are threaded onto the two bolts fixed to the first plate. Bolts extending through the holes in the second plate and threaded into the threaded apertures are provided. The nuts and bolts are unthreaded sufficiently to permit the first plate to be inserted into the duct and thereafter the nuts and bolts are tightened to draw the first and second plates together and to exert a compressive force upon the gasket.

The access door of the present invention can be inserted into any duct rectangular opening without modification of the rectangular opening in any way whatsoever. The usual procedure is to provide an access opening template with the access door of the present invention so that the template fixes the size of the rectangular duct opening and provides a rectangular opening which is two inches less on each side than the dimension of the access door so that when the access door is positioned within the duct, there is a one inch space where the access door overlaps each side of the rectangular opening.

By strategically positioning additional bolts at the four corners of the access door, the access door has been made air tight, vapor tight, and grease tight so that Underwriters Laboratories' approval has been obtained for the access door of the present invention.

Accordingly, it is an object of the present invention to provide an access door for ductwork which remains structurally intact and leak-proof under duct fire conditions.

It is another object of the present invention to provide an access door which provides easy access to the interior of ductwork.

Another object of the present invention is to provide a sandwich-type duct access door approved by Underwriters Laboratories for use with various ducting systems.

These and other objects of the present invention all become readily apparent as this description proceeds in conjunction with the accompanying drawings.

DETAILED DESCRIPTION OF THE PREFERRED EMBODIMENT

Figure 1:
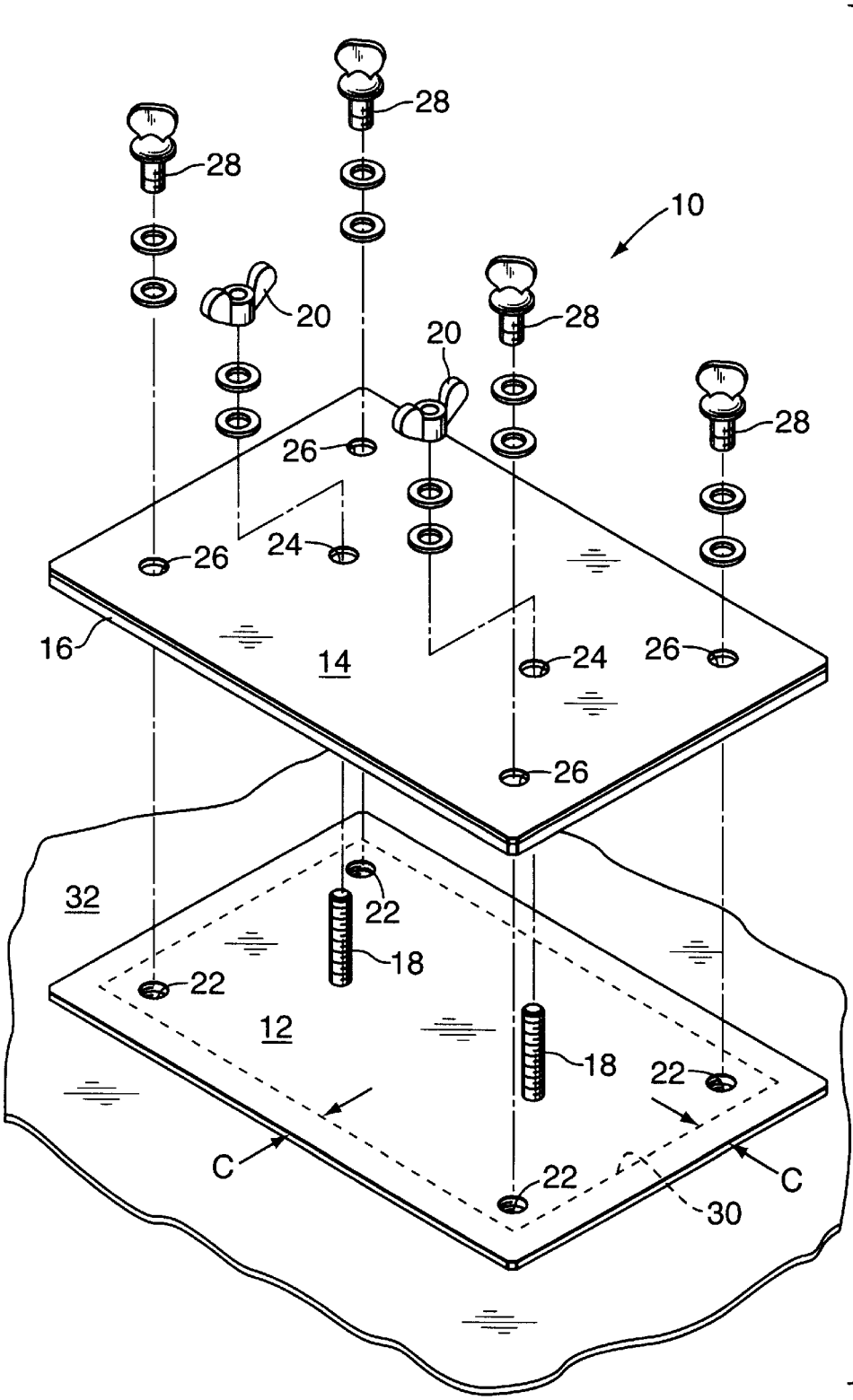
FIG. 1 is an exploded perspective view of the access door of the present invention.

Referring to the drawings, there is shown a duct access door indicated generally at 10 having a first inner rectangular plate 12 and a second outer rectangular plate 14. Gasket 16 which is coextensive with the rectangular plates 12 and 14 is fixed to the outer rectangular plate 14. The rectangular plates 12 and 14 must be rigid and are preferably formed of steel having a thickness of at least 1/16" to prevent warping of the plates by heat.

Bolts 18 are fixed to a first plate 12 and project outwardly from the first plate 12. Nuts 20 are provided to be threadingly applied to bolts 18. Threaded apertures 22 are added to four corners of first plate 12. These threaded apertures may either be holes that are tapped or they may be oversized holes over which are welded nuts to receive bolts. The threaded apertures 22 define a rectangular area which is smaller in length and width than the rectangular opening 30. The bolts 18 being disposed within the rectangular area defined by the threaded apertures 22.

Formed in the second outer rectangular plate 14 are holes 24 that register with bolts 18 fixed to plate 12. Also formed in outer plate 14 are holes 26 at the corners of the plate that register with the threaded apertures 22 on plate 12. Bolts 28 are provided to pass through holes 26 and thread into the threaded apertures 22 on plate 12.

As seen in FIG. 1, an opening 30 in a duct wall 32 is illustrated in phantom lines. The flat duct wall 32 is shown broken away from the rectangular cross-section duct for illustrational purposes. The gasket 16 is attached throughout to the outer plate 14 and is formed from ceramic fiber board material which is sold commercially by the Unifrax Corporation of Niagra Falls, N.Y. under the trademarks FIBERFRAX® and DURABOARD®. This material is resistant to flame, heat, and grease.

To install access door 10 in a duct, the nuts 20 are loosened on bolts 18 and the bolts 28 are removed from the corners of the access door. With the outer plate 14 and gasket 16 separated from the plate 12 but still loosely bolted to inner plate 12, the inner plate 12 is maneuvered through the diagonal of the rectangular opening 30 to position inner plate 12 within the duct. The bolts 28 are then inserted through the corners of outer rectangular plate 14 and bolted to inner rectangular plate 12. The nuts 20 and bolts 28 are then tightened to create a compressive force on gasket 16 and to provide a seal to the access door 10.

Figure 2:
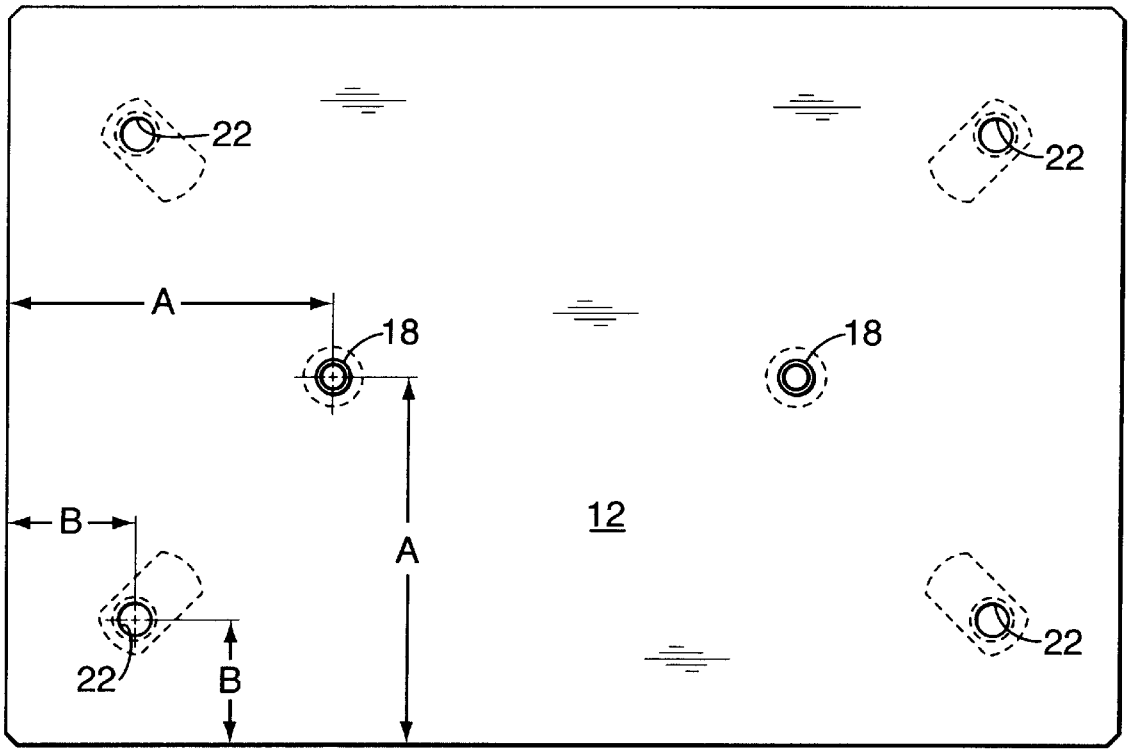
FIG. 2 is a top plan view of the inner rectangular plate of the present duct access door.
Figure 3:
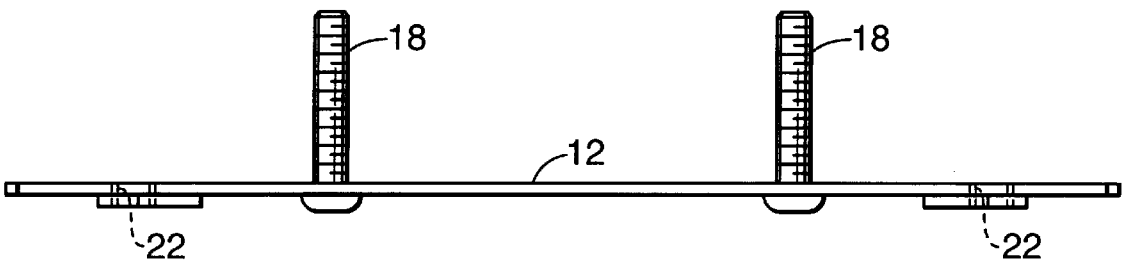
FIG. 3 is an elevation of the inner rectangular plate of FIG. 2.
Figure 4:
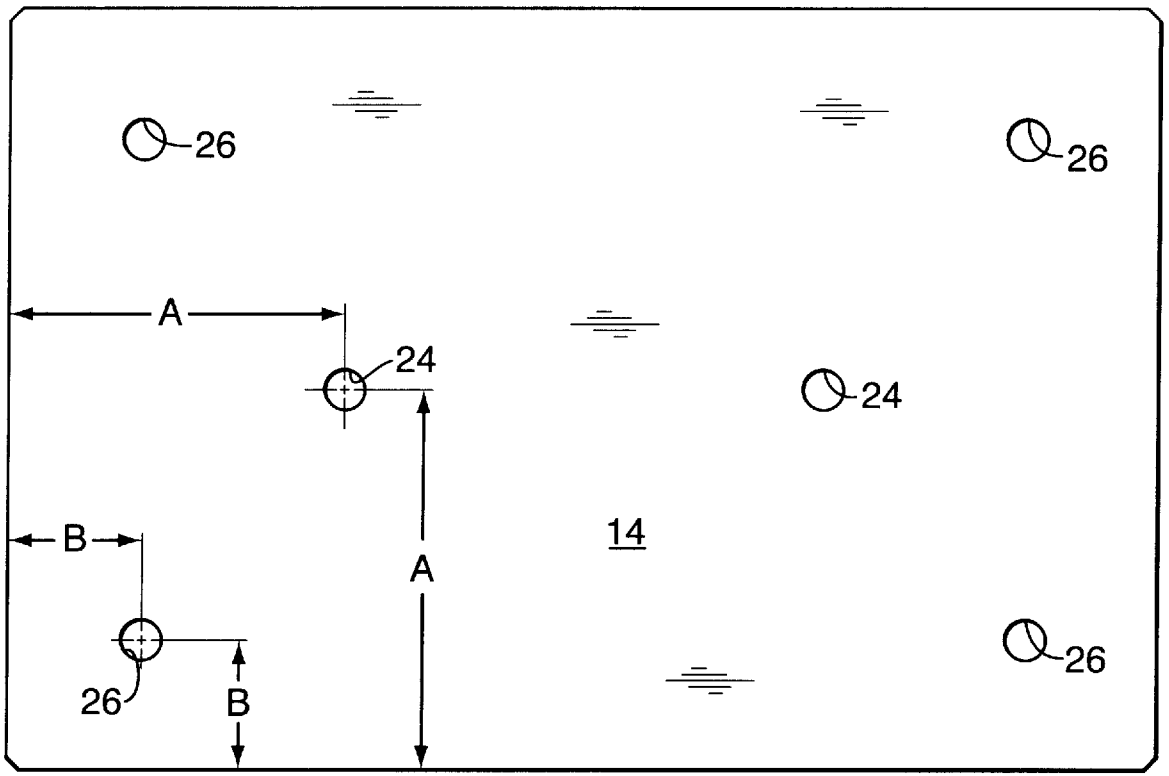
FIG. 4 is a top plan view of the outer rectangular plate of the present duct access door.
Figure 5:
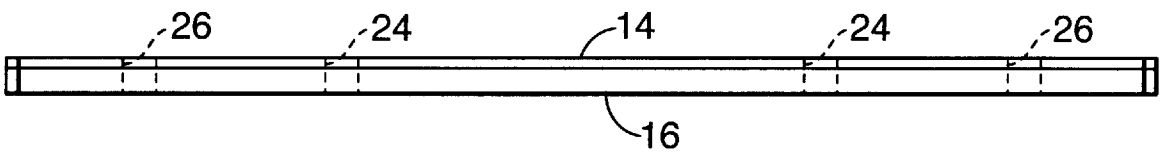
FIG. 5 is an elevation of the outer rectangular plate of FIG. 4 and the gasket affixed thereto.

It has been found that the bolts 18 should be separated by a distance A, as shown on FIGS. 2 and 3, from the edges of the respective inner and outer rectangular plates 12 and 14. The dimension A should be at least three inches so that the bolts 18 are at least three inches from any edge of the access door.

It has further been found that in order to seal the access door 10, the threaded apertures 22 in plate 12 and the holes 26 in plate 14 should have their centers at a dimension B from the edges of the plate. This dimension B should be no greater than one and one-half inches. By providing the bolts 28 at a close proximity to the corners, the bolts seal the gasket and also provide a guide when installing the access door 10 into a duct.

As indicated earlier, the dimension C is the amount of overlap of the outer plate 14 over the duct and the amount of overlap of the inner plate 12 inside the duct and is one inch all around the access door. The access door of the present invention can range in size from 8"×12" to 12"×18" or more.

In accordance with the provisions of the patent statutes, we have described the principle, mode of operation and the preferred embodiment of our invention. It should be understood that the invention may be practiced otherwise than as precisely illustrated and described herein in accordance with the claims affixed hereto.

We claim:

1. An access door to allow access to an interior of a duct having a rectangular opening formed therein comprising:

(a) a first rectangular plate larger in length and width than said duct rectangular opening and having at least four threaded apertures adjacent the corners of said plate, said at least four threaded apertures defining a rectangular area which is smaller in length and width than the duct rectangular opening, said first plate further including at least two bolts fixed to and projecting outwardly from said first plate inside said area defined by said at least four threaded apertures (b) a second rectangular plate having the same length and width as said first plate and including at least two holes registering with said bolts fixed to said first plate and at least four holes registering with said threaded apertures adjacent the corners of said first plate;

(c) a non-flammable gasket which can withstand temperatures resulting from burning debris located within said duct fixed to said second plate, said gasket positioned between said first and second plates and co-extensive with said plates;

(d) nuts threaded onto said at least two bolts fixed to said first plate; and (e) bolts extending through said at least four holes in second plate and threaded into said at least four threaded apertures in said first plate; wherein (f) said nuts and said bolts can be tightened to draw said first and second plates together and to exert a compressive force upon said gasket.

2. The access door of claim 1 wherein said first and second rectangular plates are formed of steel and are sufficiently rigid to withstand heat within said duct without warping.

3. The access door of claim 1 wherein said width of said first and second plates is two inches greater than the width of the duct rectangular opening and said length of said first and second plates is two inches greater than the length of the duct rectangular opening, so that when said first plate is positioned within the duct, said first plate extends at least one inch beyond the duct rectangular opening.

4. The access door of claim 1 wherein each of said two bolts fixed to said first plate is located at least three inches from any edge of said first plate.

5. The access door of claim 1 wherein a center of each of said threaded apertures is located not more than one and one-half inches from a respective pair of edges of said first plate.

6. The access door of claim 1 wherein said gasket is formed from ceramic fiber board.

* * * * *